US006561003B2

(12) United States Patent
Grimmel

(10) Patent No.: US 6,561,003 B2
(45) Date of Patent: May 13, 2003

(54) SUPPORT SYSTEM FOR CANTILEVERED-ROLL SHAFTS

(75) Inventor: Rüdiger Grimmel, Netphen (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 56 days.

(21) Appl. No.: 09/955,914

(22) Filed: Sep. 19, 2001

(65) Prior Publication Data

US 2002/0033037 A1 Mar. 21, 2002

(30) Foreign Application Priority Data

Sep. 20, 2000 (DE) ..... 100 46 428

(51) Int. Cl.[7] ..... B21B 29/00

(52) U.S. Cl. ..... 72/241.8; 72/237; 72/245; 72/248

(58) Field of Search ..... 72/237, 241.4, 72/241.6, 241.8, 245, 248; 74/574; 464/180

(56) References Cited

U.S. PATENT DOCUMENTS 4,036,030 A 7/1977 Papst 4,772,137 A 9/1988 Salter

FOREIGN PATENT DOCUMENTS

DE 1 255 449 7/1958

*Primary Examiner*—Ed Tolan
(74) *Attorney, Agent, or Firm*—Herbert Dubno; Andrew Wilford

(57) ABSTRACT

A rolling stand has a frame and a pair of support shafts centered on respective parallel shaft axes and each having an outer end projecting past the frame, inner and outer axially spaced bearing portions in the frame, and a gear between the respective inner and outer bearing portions. Each outer bearing portion lies between the respective inner bearing portion and the respective outer end. Respective rolls are carried on the outer ends outside the frame and respective eccentric sleeves rotatable in the frame about the axes engage the shafts at the bearing portions so that a spacing of the axes can be varied by rotating the sleeves in the frame. Respective pressure sleeves surround the shafts between the respective inner and outer bearing portions and are connected to a controller that pressurizes the sleeves and thereby bends the shafts in the frame between the inner and outer bearing portions.

3 Claims, 2 Drawing Sheets

SUPPORT SYSTEM FOR CANTILEVERED-ROLL SHAFTS

FIELD OF THE INVENTION

The present invention relates to a cantilevered-roll stand. More particularly this invention concerns a support system for the shafts of such rolls.

BACKGROUND OF THE INVENTION

In order to facilitate changing rolls and loading of a roll stand, it is known to cantilever the rolls. Thus, instead of mounting the rolls between the ends of a support shaft and supporting these end via appropriate bearings in a frame, the rolls are mounted at the ends of their shafts. Each shaft is supported in the frame on an outer bearing immediately adjacent the roll mounted on the one end of the shaft and an inner bearing at the other end of the shaft, and each shaft has between its bearings a gear that is operated by a drive unit.

German patent document 1,255,449 of Ohrnberger describes a system for pressurizing bearings of end-mounted rolls to compensate for rolling pressures. U.S. Pat. No. 4,036,030 of Papst describes a so-called pressure sleeve which hydraulically straightens a bent shaft in an end-mounted system, and U.S. Pat. No. 4,772,137 describes a similar oil-filled bearing/bushing which is used to correct deflections at the end of a shaft. Each of these systems works at the bearings where an end-mounted shaft for a center-mounted roll is carried in a frame.

The problem with the cantilevered systems is that, since each roll is only supported on one side, the outer bearing is greatly stressed and the shaft can bow somewhat. By making the frame and outer bearing extremely compact and rigid, it is possible to reduce vibration and deformation to a certain extent. Nonetheless in a finish rolling stand, it is still very difficult to reduce shaft deformation sufficiently to eliminate surface imperfections and variations in cross-sectional size in the workpiece being rolled.

OBJECTS OF THE INVENTION

It is therefore an object of the present invention to provide an improved cantilevered-roll support system.

Another object is the provision of such an improved cantilevered-roll support system which overcomes the above-given disadvantages, that is which allows even cantilevered rolls in a finish-rolling stand to be supported on axis without significant vibration or bowing of their support shaft.

SUMMARY OF THE INVENTION

A rolling stand has according to the invention a frame and a pair of support shafts centered on respective parallel shaft axes and each having an outer end projecting past the frame, inner and outer axially spaced bearing portions in the frame, and a gear between the respective inner and outer bearing portions. Each outer bearing portion lies between the respective inner bearing portion and the respective outer end. Respective rolls are carried on the outer ends outside the frame and respective eccentric sleeves rotatable in the frame about the axes engage the shafts at the bearing portions so that a spacing of the axes can be varied by rotating the sleeves in the frame. Respective pressure sleeves surround the shafts between the respective inner and outer bearing portions and are connected to a controller that pressurizes the sleeves and thereby bends the shafts in the frame between the inner and outer bearing portions.

These pressure sleeves, which can for example be formed substantially like a bearing and which set the play between the sleeve and the support shaft independently of their two bearings and independently of their oil feed, make it possible to act against bending of the support shafts and thus suppress spring-like oscillation movements of the rolls on the shafts. This improves the finish of the workpiece passing between the rolls and gives it a more uniform cross-sectional size. The shafts will not vibrate perceptibly.

The sleeves according to the invention are axially displaceable in the frame between the inner and outer bearing portions. Actuators can move them axially and/or angularly about the respective shaft axes to direct the radial forces from the sleeves against the shafts just where they are most needed to counter bending.

The sleeves are between the respective outer bearing portions and the respective gears. This places them just where bending is most pronounced.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
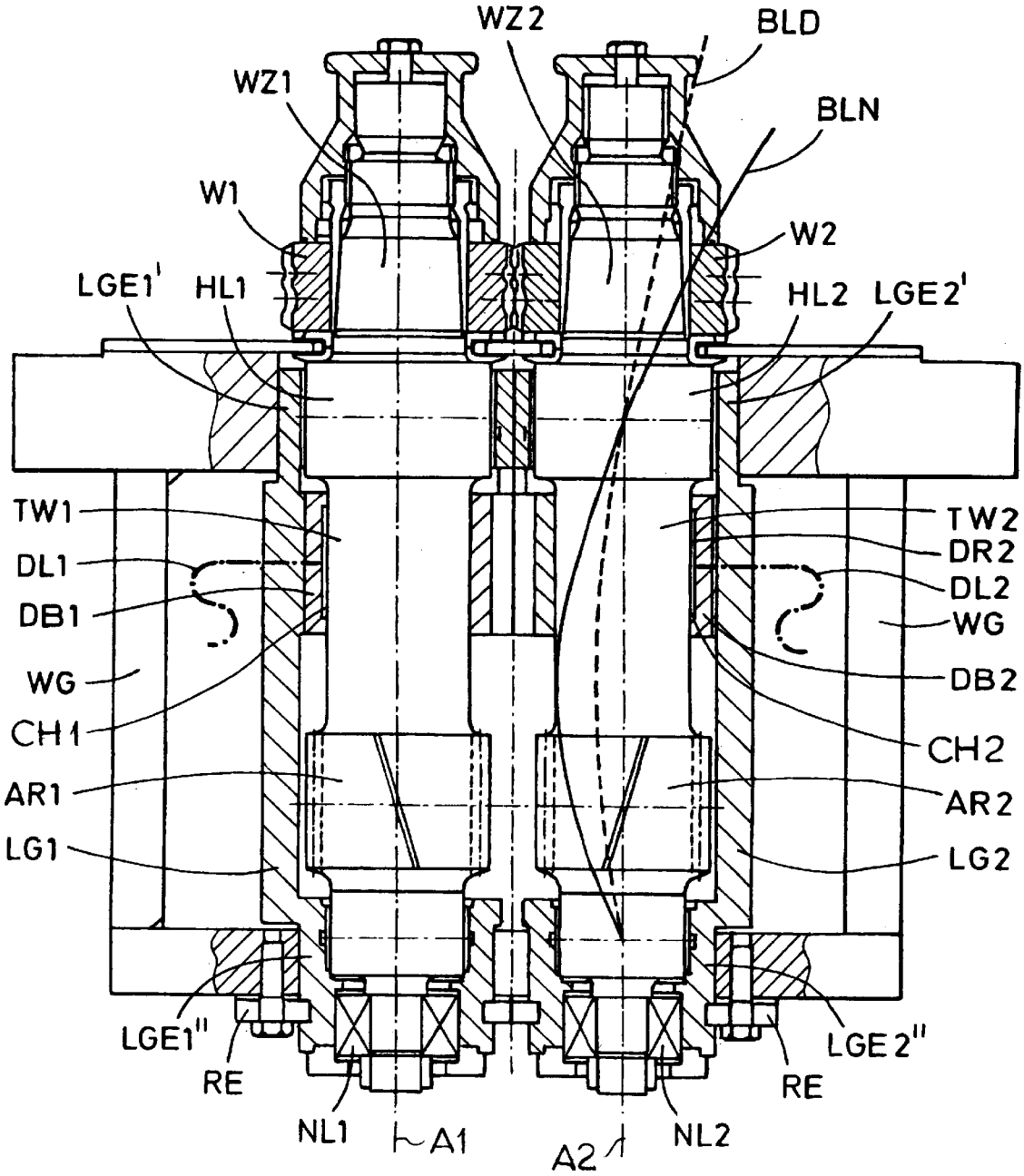
FIG. 1 is a vertical section through a finish-rolling stand according to the invention.
Figure 2:
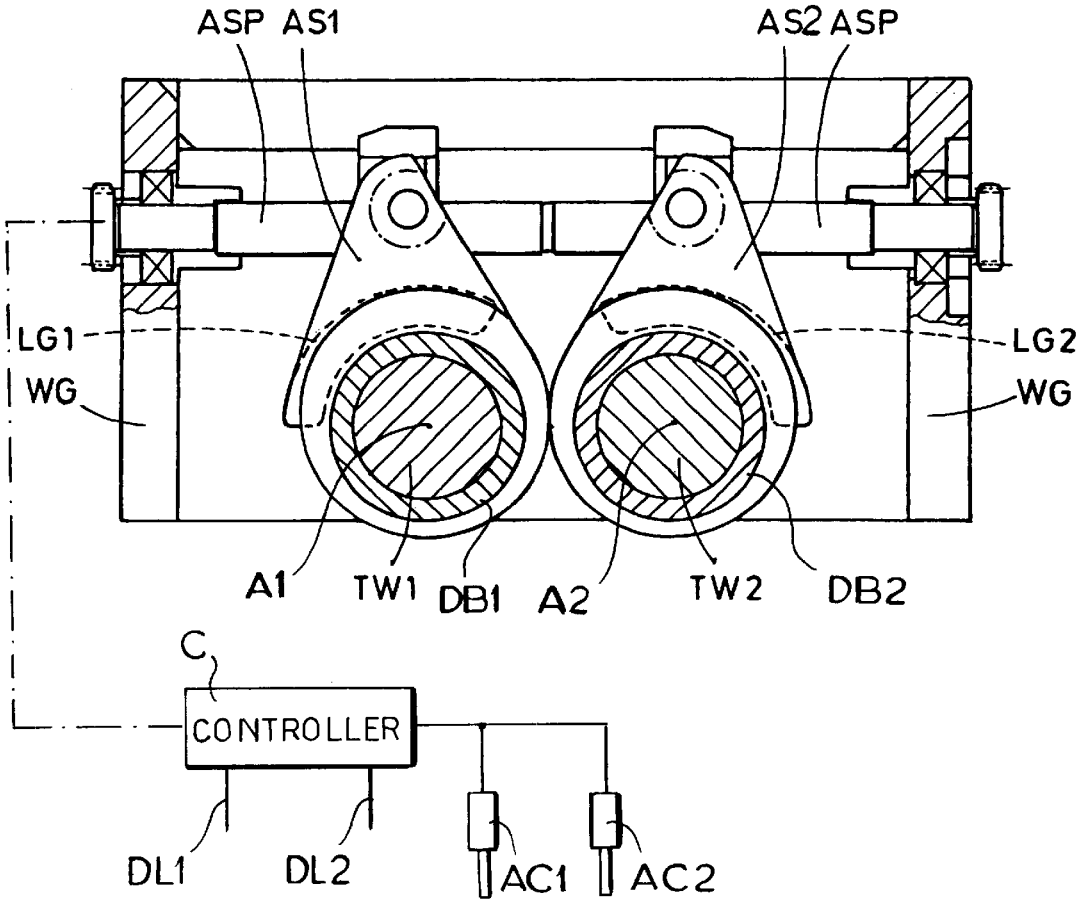
FIG. 2 is a cross section through the roll stand.

As seen in FIGS. 1 and 2 a frame WG holds a pair of substantially identical support shafts TW1 and TW2 for rotation about respective axes A1 and A2, with outer portions supported in bearings HL1 and HL2 supported in outer ends LGE1' and LGE2' of sleeves LG1 and LG2 and inner ends or portions supported in inner bearings NL1 and NL2 supported in turn in inner ends LGE1" and LGE2" of the sleeves LG1 and LG2. Projecting outer ends WZ1 and WZ2 of the shafts TW1 and TW2 carry respective finish rolls W1 and W2. Drive gears AR1 and AR2 formed on the shafts TW1 and TW2 between their bearings HL1, NL1 and HL2, NL2 are connected to an unillustrated drive motor to rotate the shafts TW1 and TW2 and their rolls W1 and W2 about the axes A1 and A2 and draw a workpiece W through between the rolls W1 and W2.

The ends LGE1', LGE1", LGE2', and LGE2" are formed as eccentric bushings internally holding the portions or bearings HL1, HL2, NL1 and NL2 and are externally secured in the frame WG. Arms AS1 and AS2 projecting radially from the sleeves LG1 and LG2 are coupled to a threaded spindle ASP (FIG. 2) that can be rotated by a controller C to adjust the spacing of the axes A1 and A2 as is known in the art.

According to the invention each shaft TW1 and TW2 is provided between its gear AR1 and AR2 and its outer bearing HL1 and HL2 with a pressure sleeve DB1 and DB2 connected via a respective hydraulic control line DL1 and DL2 to the controller C and mounted on a respective one of the sleeves LG1 and LG2. These sleeves DB1 and DB2, as described in the above-cited references, have chambers CH1 and CH2 that can be pressurized by the controller C to correct bending of the shafts TW1 and TW2. Thus as shown in FIG. 1 a fairly extreme bending of the axis A2 to the line BLN (exaggerated for clarity of view) can be reduced to a much lesser degree of bending shown at line BLD. This wholly separate control of the bending of the shafts TW1 and TW2 allows vibration and surface-affecting bending to be largely eliminated in a finish rolling stand.

Actuators AC1 and AC2 (FIG. 2 only) operated by the controller C are connected to the pressure sleeves DB1 and DB2 to move them axially and/or angularly of the respective axes A1 and A2. In this manner the radially inwardly directed forces the sleeves DB1 and DB2 apply to the shafts TW1 and TW2 can be positioned to counter any ending of the shafts TW1 and TW2 that can lead to vibration and/or spreading of the rolls W1 and W2.

I claim:

1. A rolling stand comprising:

a frame;

a pair of support shafts centered on respective parallel shaft axes and each having an outer end projecting past the frame, inner end outer axially spaced bearing portions in the frame, and a gear between the respective inner and outer bearing portions, each outer bearing portion lying between the respective inner bearing portion and the respective outer end;

respective rolls carried on the outer ends outside the frame;

respective eccentric sleeves rotatable in the frame about the axes and engaging the shafts at the bearing portions, whereby a spacing of the axes can be varied by rotating the sleeves in the frame;

respective pressure sleeves surrounding the shafts between the respective inner and outer bearing portions; and control means for pressurizing the sleeves and thereby bending the shafts in the frame between the inner and outer bearing portions.

2. The rolling stand defined in claim 1 wherein the sleeves are axially displaceable in the frame between the inner and outer bearing portions.

3. The rolling stand defined in claim 2 wherein the sleeves are between the respective outer bearing portions and the respective gears.

* * * * *